US007434804B2

(12) United States Patent
Hanada et al.

(10) Patent No.: US 7,434,804 B2
(45) Date of Patent: Oct. 14, 2008

(54) SHEET PROCESSING APPARATUS AND SHEET PROCESSING METHOD

(75) Inventors: Takako Hanada, Ibaraki (JP); Hiromichi Tsujino, Ibaraki (JP); Yuzo Matsumoto, Ibaraki (JP); Mitsushige Murata, Chiba (JP)

(73) Assignee: Canon Kabushiki Kaisha (JP)

( * ) Notice: Subject to any disclaimer, the term of this patent is extended or adjusted under 35 U.S.C. 154(b) by 540 days.

(21) Appl. No.: 10/794,517

(22) Filed: Mar. 5, 2004

(65) Prior Publication Data

US 2004/0227283 A1 Nov. 18, 2004

(30) Foreign Application Priority Data

Mar. 5, 2003 (JP) ..... 2003-058753

(51) Int. Cl.
*B65H 5/34* (2006.01)

(52) U.S. Cl. ..... 271/270; 271/202

(58) Field of Classification Search ..... 271/207, 271/264, 270, 202, 203, 314
See application file for complete search history.

(56) References Cited

U.S. PATENT DOCUMENTS 3,542,362 A * 11/1970 Brockmuller et al. ..... 271/202
5,149,080 A * 9/1992 Yamamoto ..... 271/265.01
5,181,705 A * 1/1993 Ueda et al. ..... 271/3.15
5,215,300 A * 6/1993 Hiroi et al. ..... 271/176
5,519,482 A * 5/1996 Johdai et al. ..... 399/396
6,032,779 A * 3/2000 McAlister et al. ..... 194/206
6,427,997 B1 * 8/2002 Hirota et al. ..... 270/58.12
6,783,290 B2 * 8/2004 Sussmeier ..... 400/608.4
6,893,175 B2 * 5/2005 Sussmeier et al. ..... 400/608.4
2003/0236121 A1 * 12/2003 Byers ..... 463/62

FOREIGN PATENT DOCUMENTS

JP 09-104555 A 4/1997

* cited by examiner

*Primary Examiner*—Patrick Mackey
*Assistant Examiner*—Michael C McCullough
(74) *Attorney, Agent, or Firm*—Rossi, Kimms & McDowell, LLP

(57) ABSTRACT

A sheet processing apparatus which is capable of discharging a sheet at the optimum sheet discharging speed without stopping the conveyance of the sheet irrespective of differences in sheet conveying speed according to sheet types. A sheet discharging motor is controlled to drive a discharging roller to convey sheets in selected one of a first state in which the sheets are conveyed at speeds within a first speed range specified by a first maximum speed and a first minimum speed, and a second state in which the sheets are conveyed at speeds within a second speed range specified by a second maximum speed lower than the first maximum speed and a second minimum speed lower than the first minimum speed. The first speed range includes an overlapping range where the first speed range and the second speed range overlap.

11 Claims, 13 Drawing Sheets

SHEET PROCESSING APPARATUS AND SHEET PROCESSING METHOD

BACKGROUND OF THE INVENTION

1. Field of the Invention

The present invention relates to a sheet processing apparatus and a sheet processing method which convey a sheet at a predetermined conveying speed.

2. Description of the Related Art

In recent years, image processing apparatuses of an electrophotographic type such as copying machines and printers can change the sheet conveying speed according to sheet types. This is to prevent deterioration of the fixability of toner on thick paper by decreasing the fixing speed because thick paper or the like has a lower toner fixability as compared with plain paper.

On the other hand, a sheet processing apparatus which receives a sheet discharged from an image forming apparatus, and carries out sheet processing such as stapling on the sheet increases the sheet conveying speed at which the received sheet is conveyed, to a predetermined speed so as to separate the sheet being conveyed from the succeeding sheet, and then reduces the sheet conveying speed to a speed suitable for discharge of the sheet onto a processing tray on which processing such as stapling is carried out. The increase/decrease in sheet conveying speed is caused by changing the rotational speed of a motor which drives rollers conveying sheets.

In the case where the above sheet processing apparatus is connected to the above described image forming apparatus which can change the sheet conveying speed according to sheet types, the conveying speed in the sheet processing apparatus must be variable within the range between the maximum speed in conveyance of plain paper and the minimum speed in conveyance of thick paper.

However, the range of conveying speeds which can be realized by one motor, i.e. the upper limit and the lower limit of the speed at which the motor is able to normally operate are limited. Therefore, even if the motor is tried to rotate at a speed outside the range, the target conveying speed cannot be reached, or even if the target conveying speed is reached, motor torque required for sheet conveyance cannot be obtained. To prevent such a situation, the use of a motor capable of running in a wide speed range is envisaged, but this would increase not only costs but also the size of the motor.

In a sheet discharging apparatus (image processing apparatus) disclosed in Japanese Laid-Open Patent Publication (Kokai) No. H9-104555, when a sheet is discharged onto a discharged sheet tray, a gear shift means transmits the rotation of a motor to discharging rollers to cause a sheet conveyed from conveying rollers to be discharged onto the discharged sheet tray by the discharging rollers, and on the other hand, in the case where a sort means is connected in place of the discharged sheet tray to the image forming apparatus, the gear shift means switches the gear ratio to a low speed gear ratio to cause a sheet to be discharged to the sort means at a lower speed than in the case where the discharged sheet tray is connected. If this is applied, it is possible to provide a sheet processing apparatus which can accommodate a wide range of speeds without using a motor capable of running in a wide speed range.

However, to prevent a sheet from being stopped while being conveyed, it is necessary to avoid changing of gears while the sheet is being conveyed, and also, when the sheet processing apparatus discharges a sheet onto a processing tray, it is desirable that the speed is changed to a predetermined speed suitable for discharge irrespective of whether the sheet is plain paper or thick paper.

SUMMARY OF THE INVENTION

It is an object of the present invention to provide a sheet processing apparatus and a sheet processing method which are capable of discharging a sheet at the optimum sheet discharging speed without stopping the conveyance of the sheet irrespective of differences in sheet conveying speed according to sheet types.

To attain the above object, in a first aspect of the present invention, there is provided a sheet processing apparatus comprising a conveying device that conveys sheets, a driving device that drives the conveying device, and a controller that controls the driving device, the controller controls the driving device to drive the conveying device in selected one of a first state in which the sheets are conveyed at speeds within a first speed range specified by a first maximum speed and a first minimum speed, and a second state in which the sheets are conveyed at speeds within a second speed range specified by a second maximum speed lower than the first maximum speed and a second minimum speed lower than the first minimum speed, and the first speed range includes an overlapping range where the first speed range and the second speed range overlap.

Preferably, the controller inhibits the driving device from switching between the first state and the second state while the conveying device is conveying one of the sheets.

Also preferably, a first discharging speed at which the sheets are discharged by the conveying device in the first state is substantially equal to a second discharging speed at which the sheets are discharged by the conveying device in the second state, and the first discharging speed lies inside the overlapping range.

Also preferably, the conveying device receives the sheets at two least receiving speeds, and at least one of the receiving speeds lies outside the first speed range and lies inside the second speed range.

To attain the above object, in a second aspect of the present invention, there is provided a sheet processing apparatus comprising a conveying device that conveys sheets at a predetermined conveying speed, a selecting device that selects a speed range from among at least two different speed ranges, a speed controller that controls the predetermined conveying speed within the speed range selected by the selecting device, and a setting device that sets a conveying speed at which the sheets are conveyed at a predetermined position to a speed within a common speed range where the at least two speed ranges overlap.

Preferably, the speed controller comprises a driving device that drives the conveying device, a first transmitting device that transmits power of the driving device to the conveying device so as to control a conveying speed at which the sheets are conveyed by the conveying device to a speed within a first speed range selected by the selecting device, a second transmitting device that transmits power of the driving device to the conveying device so as to control a conveying speed at which the sheets are conveyed by the conveying device to a speed within a second speed range selected by the selecting device, and a switching device that connects a transmission path for the power of the driving device to a selected one of the first transmitting device and to the second transmitting device.

More preferably, the driving device comprises a driving motor, the first transmitting device is operable when the driving motor is rotating forward, to transmit torque of the driving motor to the conveying device, and the second transmitting device is operable when the driving motor is rotating backward, to transmit torque of the driving motor to the conveying device.

Also preferably, the conveying device comprises a conveying path, and a stacking device that stacks sheets having been guided to the conveying path and discharged therefrom, and the conveying speed at the predetermined position is a discharging speed at which the sheets are discharged from the conveying path to the stacking device.

More preferably, the sheet processing apparatus comprises a sandwiching device that lowers and sandwiches trailing ends of the sheets discharged from the conveying path, and the sandwiching device stacks the sheets in the stacking device by pulling back the lowered trailing ends of the sheets.

Also more preferably, the setting device sets the discharging speed at which the sheets are discharged to the stacking device to a maximum speed among speeds within a speed range at which the sheets can be stacked in the stacking device.

Also preferably, the speed controller inhibits the selecting device from selecting a speed range other than the selected speed range for a period of time from conveyance of the sheets into the sheet processing apparatus to discharge of the sheets form the sheet processing apparatus.

Also preferably, the selecting device selects a speed range from among the at least two different speed ranges according to conditions of the sheet to be conveyed.

Also preferably, the sheet processing apparatus is connected to an image forming apparatus, the conveying device conveys sheets conveyed from the image forming apparatus.

To attain the above object, in a third aspect of the present invention, there is provided a sheet processing method comprising a conveying step of conveying sheets at a predetermined speed, a selecting step of selecting a speed range from among at least two different speed ranges, a speed control step of controlling the predetermined conveying speed within the speed range selected in the selecting step, and a setting step of setting a conveying speed at which the sheets are conveyed at a predetermined position to a speed within a common speed range where the at least two different speed ranges overlap.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the accompanying drawings showing a preferred embodiment thereof.

Figure 1:
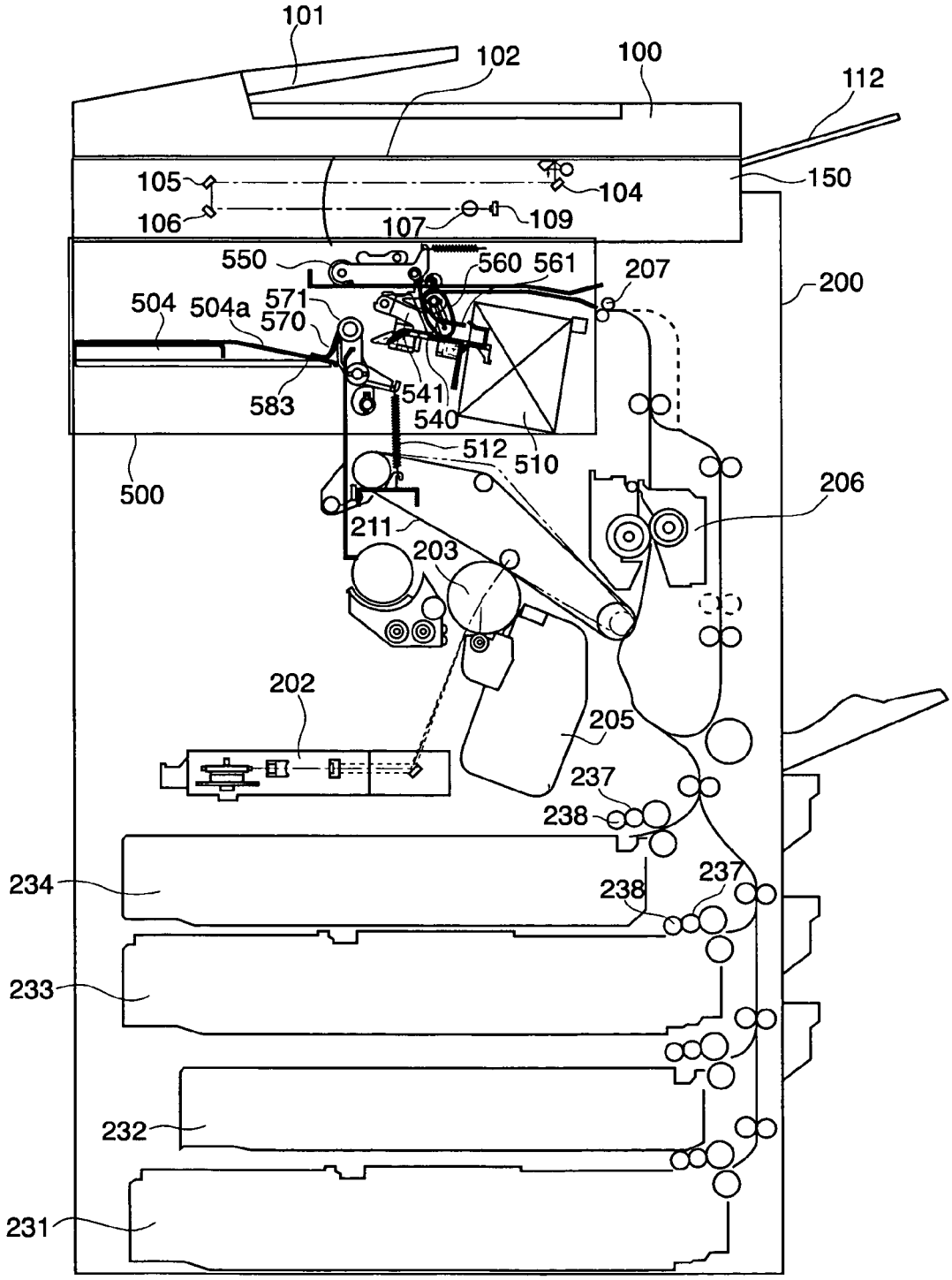
FIG. 1 is a sectional view showing the construction of an image processing apparatus provided with a sheet processing apparatus according to an embodiment of the present invention.

FIG. 1 is a sectional view showing the construction of an image forming apparatus provided with a sheet processing apparatus according to an embodiment of the present invention. The sheet processing apparatus according to the present embodiment is provided in an image forming apparatus. In FIG. 1, reference numeral 200 denotes an image forming apparatus main body. An original reader 150 is provided on an upper side of the image forming apparatus main body 200, and an automatic original reader 100 is mounted on top of the original reader 150. Further, the sheet processing apparatus 500 according to the present embodiment, which is stored in a housing of the image forming apparatus, is provided in an upper part of the image forming apparatus main body 200 and below the original reader 150.

The automatic original reader 100 separates originals, which are set on an original tray 101 with upper surfaces thereof facing upward, from the top, feeds the originals one by one in sequence from the top page to the left as viewed in FIG. 1, conveys each original onto a platen glass 102 via a curved path, not shown., and reads and discharges each original onto a discharged sheet tray 112.

Light from a lamp of a scanner unit 104 is irradiated upon the original placed on the platen glass 102, and light reflected from the original is led to an image sensor 109 via optical elements such as mirrors 105 and 106 and a lens 107, so that the original is read. Image data of the original read by the image sensor 109 is subjected to image processing, and then transmitted to an exposure controller 202. The exposure controller 202 emits laser light based on the image data.

The laser light is reflected by a rotating polygon mirror, and is reflected again by a reflex mirror and irradiated upon a photosensitive drum 203 with the surface thereof uniformly electrified. The irradiation of the laser light forms an electrostatic latent image on the photosensitive drum 203. The electrostatic latent image on the photosensitive drum 203 is developed by a developing device 205, and then transferred as a toner image on a sheet S such as thick paper and an OHP sheet.

Sheets S are selectively let out from a sheet cassette 231, 233, or 234 by a pick-up roller 238, and separated sheet by sheet by a separating section 237 and then fed. The sheet S is corrected for skew by a pair of pre-resist rollers, and led to a transfer position in synchronism with rotation of the photosensitive drum 203. This causes the toner image formed on the photosensitive drum 203 to be transferred onto the sheet S via a transfer belt 211.

The sheet S is then led to a pair of fixing rollers 206, and is heated and pressurized by the fixing rollers 206, so that the transferred toner image is fixed on the sheet S. A fixing upper separation claw and a fixing lower separation claw are disposed in abutment on the respective fixing rollers 206 to separate the sheet S from the fixing rollers 206. The separated sheet S is conveyed by a pair of main body side discharging rollers 207 to the sheet processing apparatus 500 provided in the housing of the image forming apparatus.

Figure 2:
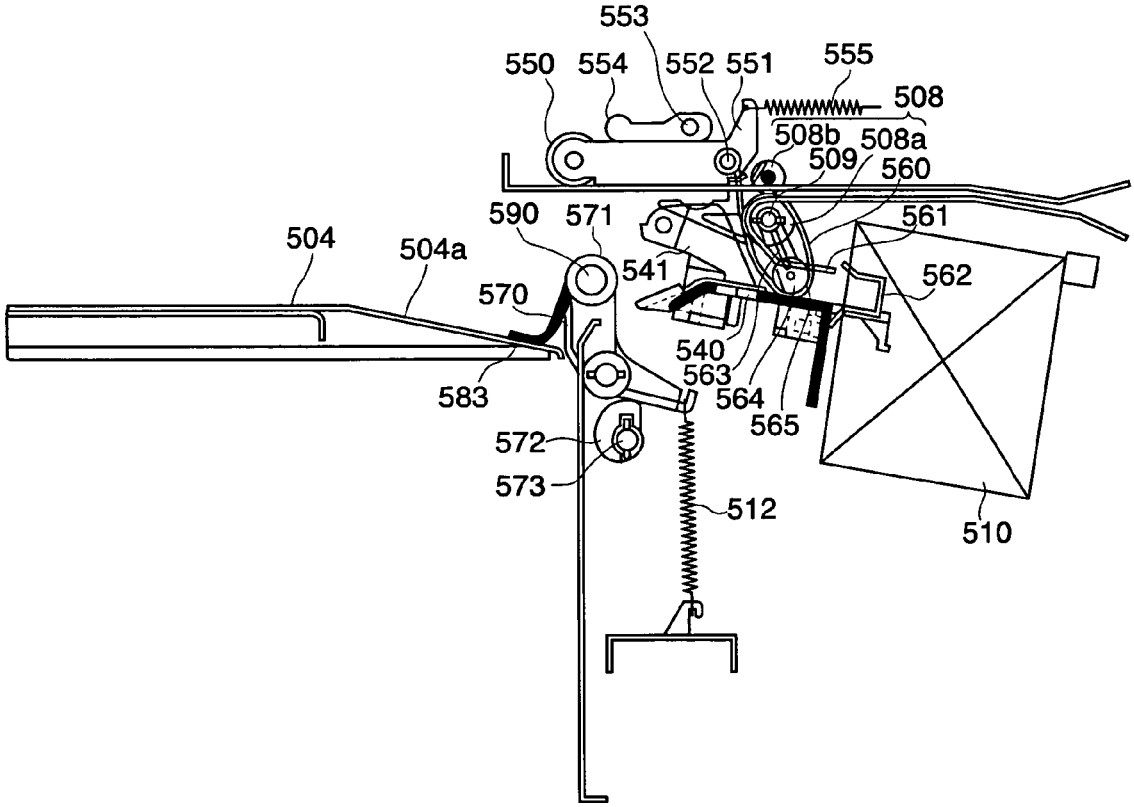
FIG. 2 is a front view showing the construction of the sheet processing apparatus in FIG. 1.
Figure 3:
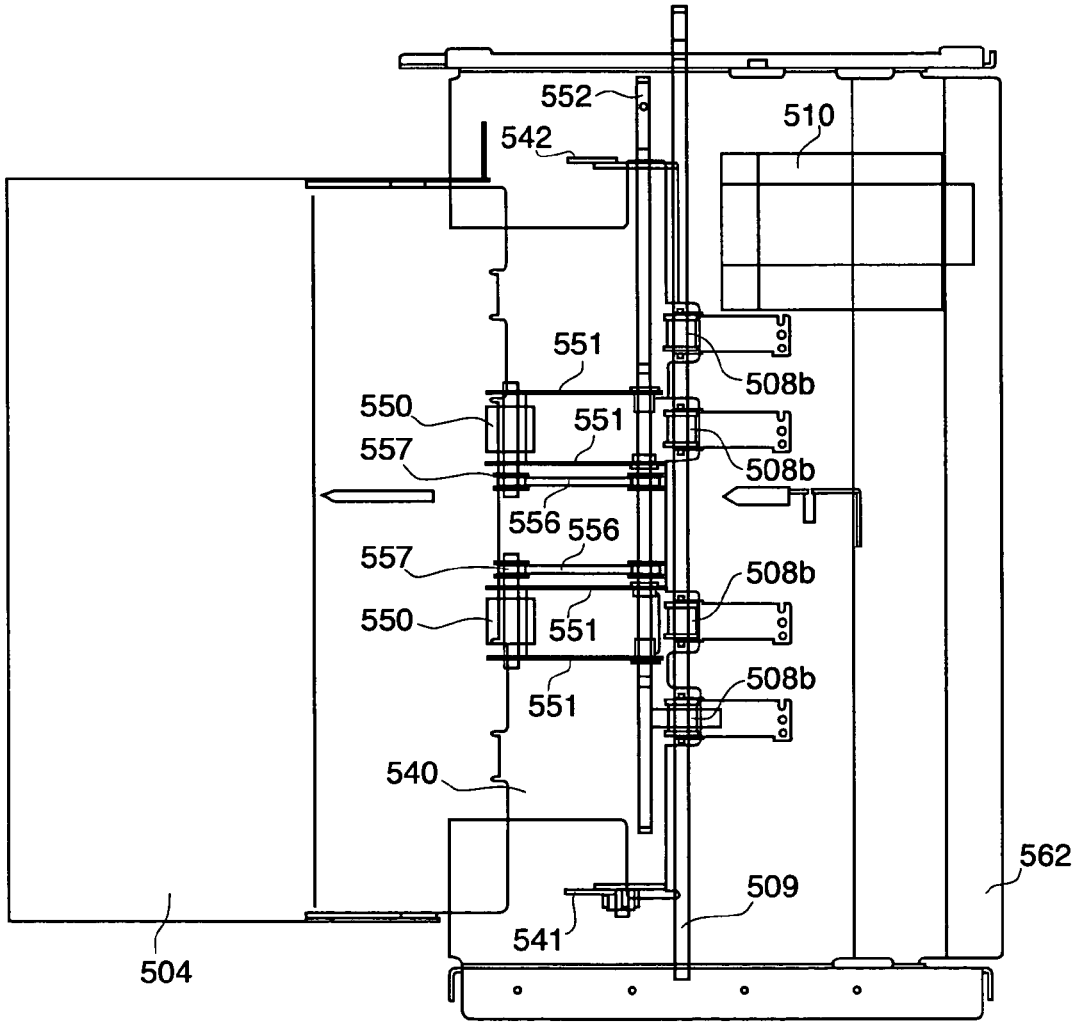
FIG. 3 is a plan view showing the construction of the sheet processing apparatus in FIG. 2.

FIG. 2 is a front view showing the construction of the sheet processing apparatus 500 provided in the image forming apparatus in FIG. 1. FIG. 3 is a plan view showing the construction of the sheet processing apparatus 500. The sheet processing apparatus 500 includes a processing tray 540 on which sheets S with images formed thereon discharged from the image forming apparatus main body 200 are temporarily stacked, and a stack tray 504 which is located downstream of the processing tray 540 and disposed substantially horizontally and on which sheets S discharged from the processing tray 540 are stacked.

The sheet S discharged by the main body side discharging rollers 207 of the image forming apparatus main body 200 is discharged toward the stack tray 504 by a discharging section 508 on the sheet processing apparatus 500 side, which is comprised of a discharging roller 508*a* and a discharging roller 508*b* following the discharging roller 508*a*. On this occasion, in timing in which the trailing end of the sheet S passes the discharging section 508, the trailing end of the sheet S is dropped onto the processing tray 540 by a sandwiching device, which includes a swinging roller 550 and a following roller 571, into a state sandwiched between the swinging roller 550 and the following roller 571. The operation of the swinging roller 550 will be described later in further detail.

The sheets S thus discharged onto the processing tray 540 in the sheet processing device 500 are subjected to post processing such as stapling and aligning on the processing tray 540, and then stacked on the stack tray 504. Examples of post processing modes executed on the processing tray 540 are a sort mode in which sheets S are sorted into a plurality of groups, and a stapling mode in which a plurality of sheets are stapled by a stapler unit 510. The post processing mode is selected and set by an operator via an operating section 380 (refer to FIG. 8) before a post processing job is started. In the stapling mode, it is possible to designate one-point stapling, two-point stapling, stapling position, or the like. The stapler unit 510 moves to a stapling position according to settings as to sheet size, stapling position, and so forth.

Figure 4A:
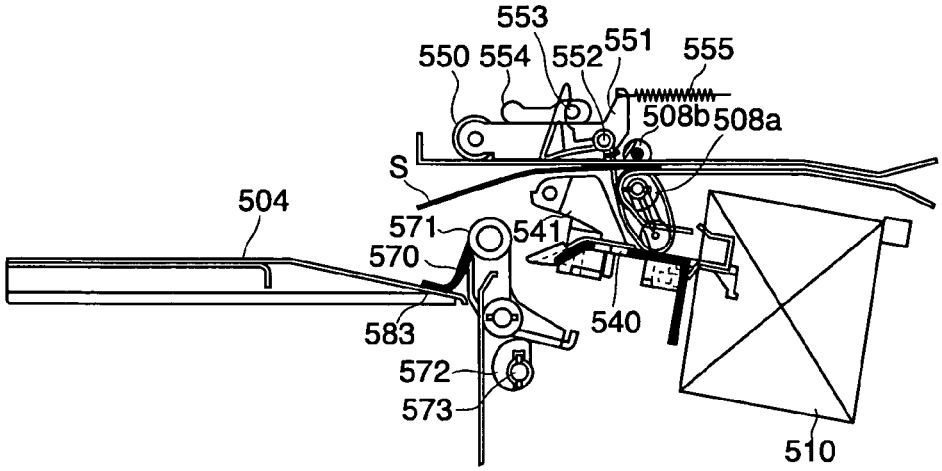
FIGS. 4A to 4C are views useful in explaining the operation of a swinging roller in the sheet processing apparatus.
Figure 4B:
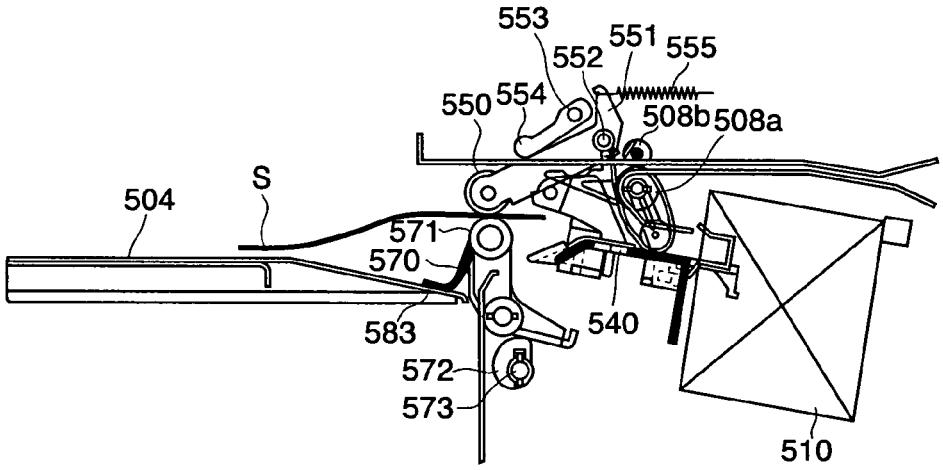
Figure 4C:
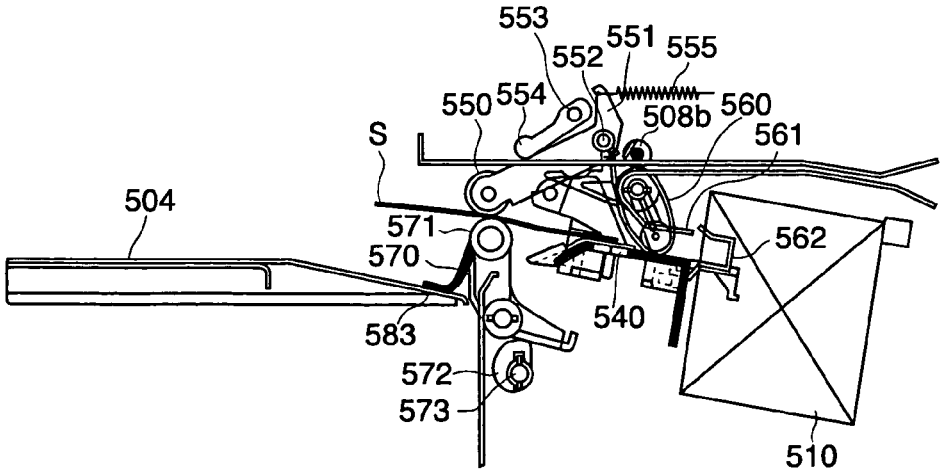

FIGS. 4A to 4C are views useful in explaining the operation of the stacking device, which includes a swinging arm 551 and the swinging roller 550, of the sheet processing apparatus 500. The swinging roller 550 is attached to the swinging arm 551 which is capable of vertically swinging about a swinging roller shaft 552. Power is transmitted from a swinging arm driving motor 643 (refer to FIG. 9) to a swinging arm shaft 553 which pivotably supports a swinging cam 554. In response to rotation of the swinging arm driving motor 643, the swinging arm 551 vertically swings about the swinging roller shaft 552 in unison with the swinging cam 554. Further, a swinging arm tension spring 555 for assisting in upward swinging of the swinging arm 551 is attached to the swinging arm 551.

The swinging roller 550 is connected to the swinging roller driving motor 643 (refer to FIG. 9) via a swinging roller driving belt 556 (refer to FIG. 3), a swinging roller following pulley 557, and the swinging roller shaft 552. When the swinging roller driving motor 642 is rotated in response to a driving signal transmitted from a CPU 611, described later with reference to FIG. 9, via a roller driving motor driver 622, torque of the swinging roller driving motor 642 is transmitted to the swinging roller 550, so that the swinging roller 550 is rotated.

As shown in FIG. 4A, the home position of the swinging roller 550 is set at an upper location so as not to abut on the sheet S discharged onto the processing tray 540 by the discharging section 508. When the sheet S is discharged from the discharging section 508, and the arm 551 rotates counterclockwise about the swinging roller shaft 552 in response to driving energy from the swinging arm driving motor 643, the swinging roller 550 moves down to press the trailing end of the discharged sheet S and drops it toward the processing tray 540, as shown in FIG. 4B. At the same time, the swinging roller 550 forms a nip with the following roller 571, and rotates counterclockwise in response to driving energy from the swinging roller driving motor 642, so that as shown in FIG. 4C, the sheet S is pulled along a lower guide 561 in a direction opposite to the direction in which the sheet S has been conveyed until the trailing end of the sheet S dropped onto the processing tray 540 abuts on a return belt 560. Thereafter, the swinging roller 550 moves up to the home position shown in FIG. 4A, and prepares for discharge of the next sheet S.

Figure 5A:
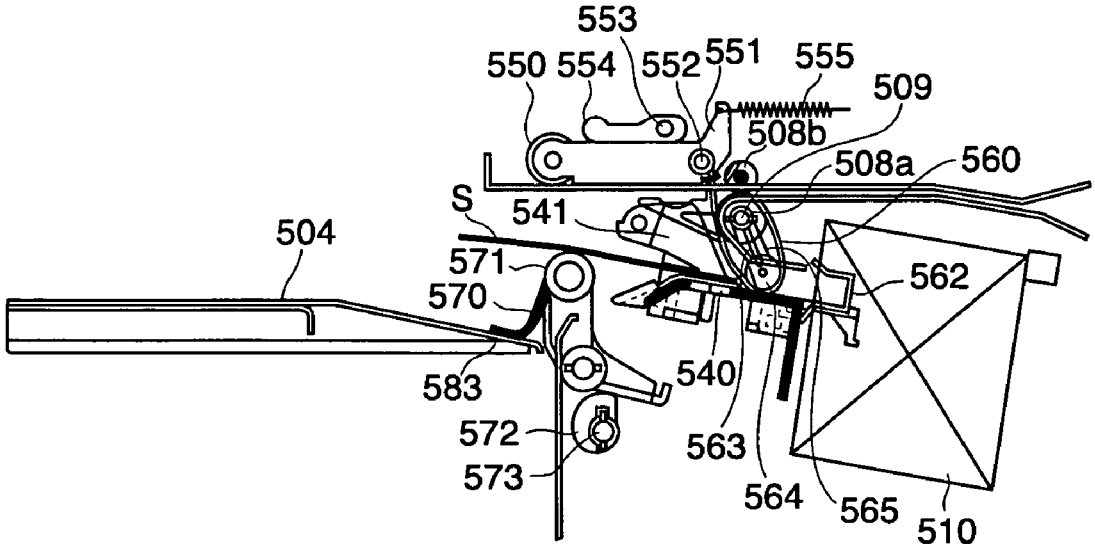
FIGS. 5A and 5B are views useful in explaining the operation of a return belt in the sheet processing apparatus.
Figure 5B:
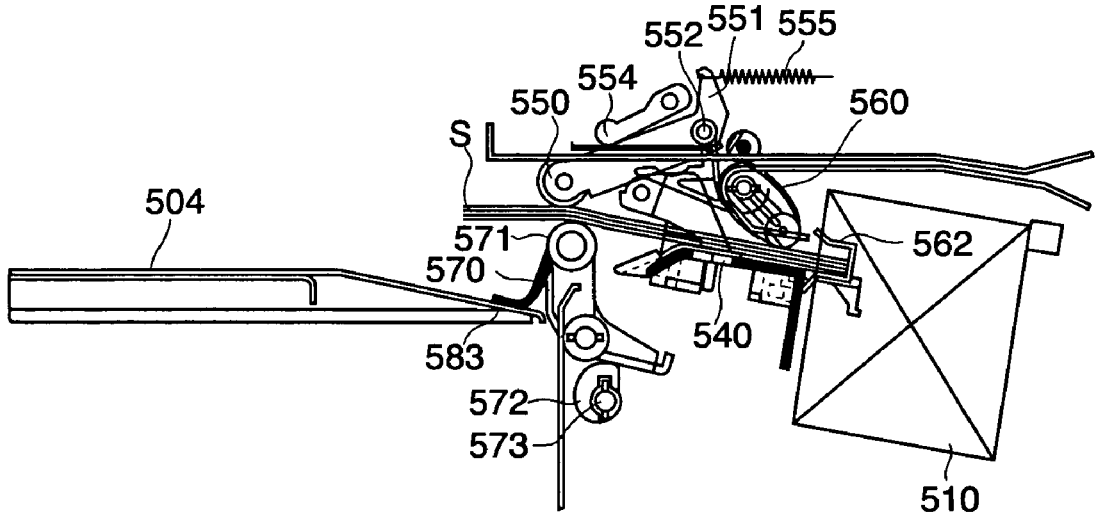

FIGS. 5A and 5B are views useful in explaining the operation of the return belt 560 in the sheet processing apparatus 500. The return belt 560 is supported by a discharging roller shaft 509, and is comprised of the discharging roller 508 pivotably supported by the discharging roller shaft 509, a return belt pulley 564 supported by a housing 563, and a belt member 565 wound around the discharging roller 508*a* and the return belt pulley 563 (refer to FIG. 2). The return belt 560 is at least one sheet feeding rotary member, and is normally disposed at such a location as to come into contact with the sheet S on the processing tray 540 so as to urge the sheet S against a sheet trailing stopper 562.

As shown in FIG. 5A, when the discharging roller shaft 509 rotates counterclockwise, the belt member 565 conveys the sheet S in a direction toward the sheet trailing stopper 562. Further, as shown in FIG. 5B, the return belt 560 swings in such a manner as to go away from the sheets S stacked on the processing tray 540 with an increase in the thickness of the sheet stack.

The sheets S thus pressed counterclockwise by the swinging roller 550 and the return belt 560 are received by the sheet trailing end stopper 562 located at an end of the processing tray 540, and aligned sheet by sheet in the sheet conveying direction.

A front aligning plate 541 and a rear aligning plate 542 (refer to FIG. 3), which are moveable in parallel with the discharging roller shaft 509 are provided on the sheet processing tray 540. The front aligning plate and the rear aligning plate 542 are driven by a front aligning motor 646 (refer FIG. 9) and a rear aligning plate 647 (refer FIG. 9), respectively.

While the sheet processing apparatus 500 is not in operation, the front aligning plate 541 and the rear aligning plate 542 are waiting at respective positions which are detected by a front alighting home position sensor 530 (refer to FIG. 9) and a rear aligning home position sensor 531 (refer to FIG. 9), respectively. These positions are called "aligning home positions (reference positions)", and are set at positions such that the sheet S being conveyed does not come into contact with the front aligning plate 541 and the rear aligning plate 542.

The front aligning plate 541 and the rear aligning plate 542 move to respective waiting positions suitable for the size of the sheets S before the sheets S are conveyed from the image forming apparatus. After the sheets S are aligned in the sheet conveying direction as above, the front aligning plate 541 and the rear aligning plate 542 are moved to respective sheet aligning positions in the post-processing mode set before the start of a job, so that the sheets S are aligned in the direction of the width thereof, i.e. in a direction perpendicular to the sheet conveying direction.

For example, in the case where the sheets S of the Nth copy are aligned in the direction of the width thereof in the sort mode, the front aligning plate 541 is caused to wait at the reference position, and the rear aligning plate 542 is moved from the waiting position to the sheet aligning position, so that the sheets S are aligned at edges thereof at an inner side with respect to the sheet surface of FIGS. 5A and 5B. Then, as described later, the aligned sheets S are discharged to the stack tray 540.

In the case where the sheets S of the N+1th copy are aligned, the rear aligning plate 542 is caused to wait at the reference position, and the front aligning plate 541 is moved from a waiting position to an aligning position, so that the sheets S are aligned at edges thereof at an outer side with respect to the sheet surface of FIGS. 5A and 5B thereof. Then, the aligned sheets S are discharged to the stack tray 540 as above. As a result, the sheets S can be stacked on the stack tray 540 while they are sorted each time a bundle of sheets S is discharged. It should be noted that the sheets S may be aligned at middle positions thereof, and in this case, both the front aligning plate 541 and the rear aligning plate 542 are moved from respective waiting positions to aligning positions suitable for the middle positions.

Also, when the stapling mode is selected, the sheets S are aligned in the direction of the width thereof at a position suitable for a set stapling position, and then they are stapled. On this occasion, the stapler unit 510 is driven by a staple clinch motor 648 (refer to FIG. 9) to staple the sheets S. The stapler unit 510 is driven by a staple slide motor 649 (refer to FIG. 9) to freely move in a direction vertical to the sheet surface of FIGS. 5A and 5B (i.e. in a direction vertical to the sheet conveying direction). Upon the start of a job, the stapler unit 510 moves to an actual stapling position which has been determined in dependence on a stapling position and a sheet size designated before the start of the job. Then, the stapler unit 510 staples a bundle of the sheets S aligned in the direction of the width thereof as above.

Figure 6A:
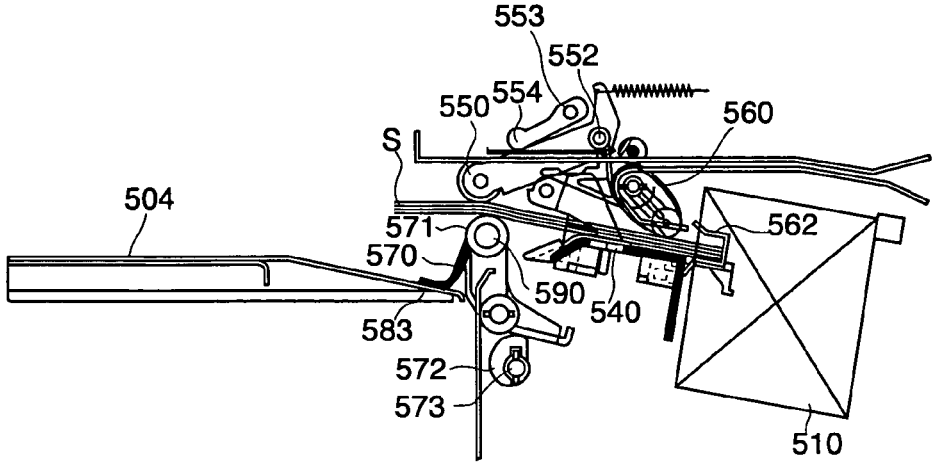
FIGS. 6A to 6C are views useful in explaining a bundle discharging operation carried out by the swinging roller.
Figure 6B:
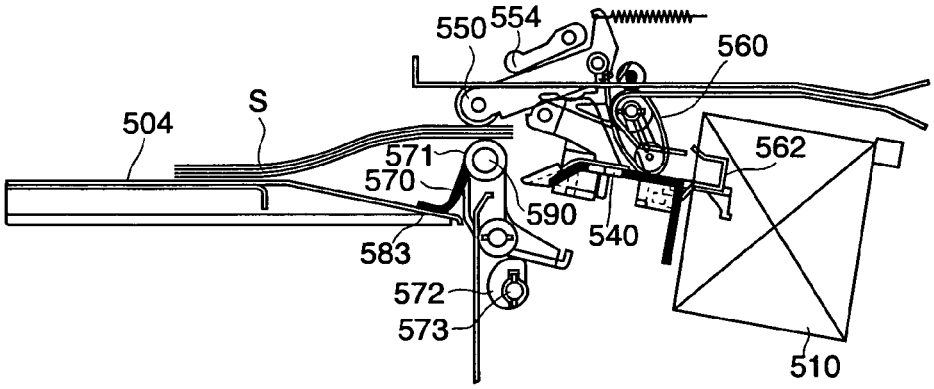
Figure 6C:
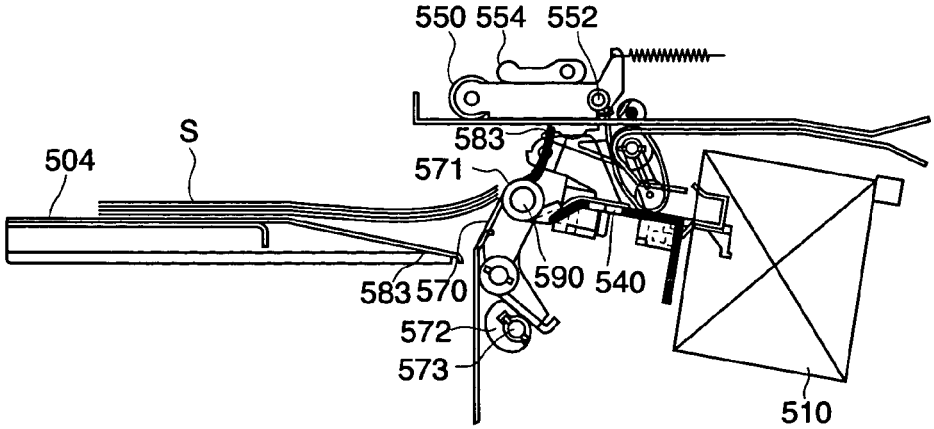

FIGS. 6A to 6C are views showing how a bundle of sheets S is discharged by the swinging roller 550. After a bundle of sheets S is aligned in the sheet conveying direction and in the direction of the width thereof, and stapled as above, the swinging roller 550 is driven by the swinging arm driving motor 643 to move down about the swinging roller shaft 552 until it abuts on the bundle of sheets S as shown in FIG. 6A. Then, the swinging roller 550 forms a nip with the following roller 571, and rotates clockwise to convey the bundle of sheets S until the trailing end of the bundle of the sheets S reaches a position in the vicinity of an upper end of a trailing end aligning wall member 570 (refer to FIG. 6B), and then stops the bundle of sheets S.

Then, the swinging roller 550 comes apart from the bundle of sheets S and returns to its home position (refer to FIG. 6C). At the same time, a cam 572 located below the trailing end aligning wall 570 rotates about a cam swinging rotary shaft 573, the trailing end aligning wall 570 swings about a swinging shaft 570*a* in a direction away from the bundle of sheets S. The operations of the trailing end aligning wall member 570 and the cam 572 will be described later.

Figure 7A:
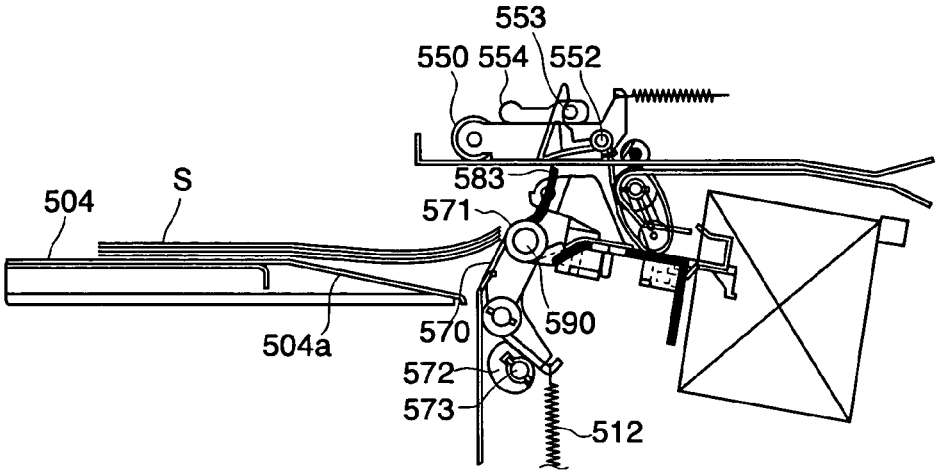
FIGS. 7A to 7C are views useful in explaining an operation for discharging a bundle of sheets on a processing tray of the sheet processing apparatus onto a stack tray, and aligning/stacking the bundle of sheets on the stack tray.
Figure 7B:
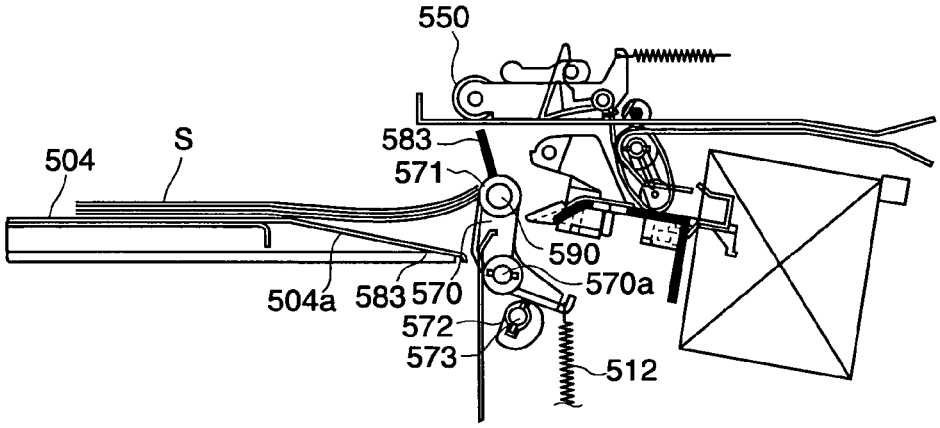
Figure 7C:
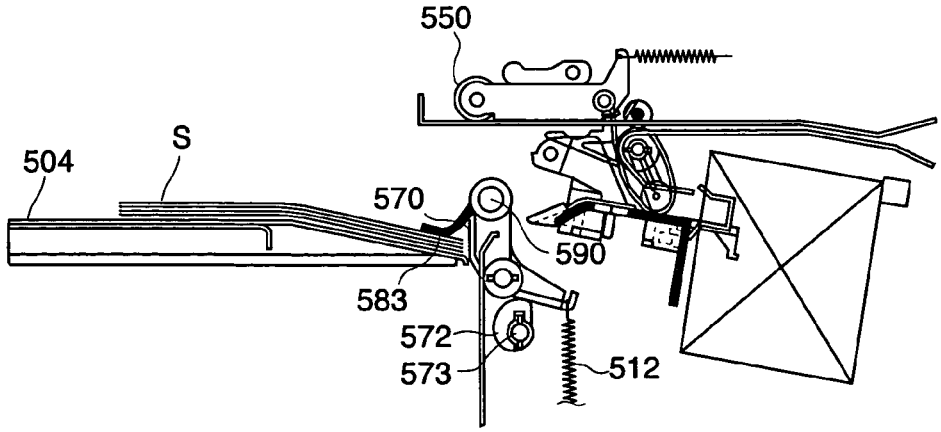

FIGS. 7A to 7C are views showing how a bundle of sheets S on the sheet processing tray 540 of the sheet processing apparatus 500 is discharged onto the stack tray 504, and aligned and stacked on the stack tray 540. The rear end aligning wall member 570 can swing about the swinging rotary shaft 570*a*, and has one end 570*b* thereof urged by a spring 512. The one end 570*b* is in abutment on the cam 572 that is rotatable about the cam swinging rotary shaft 573; when the cam 572 lying at its home position (refer to FIG. 6A) rotates, the rear end aligning wall member 570 swings in a direction opposite to the direction in which the bundle of sheets S is conveyed.

The trailing end of the discharged bundle of sheets S comes into abutment on the upper end of the trailing end aligning wall member 570 (refer to FIG. 6B), the trailing end aligning wall member 570 is moved back upstream in the sheet conveying direction, so that the trailing end of the bundle of sheets S comes into abutment on an inclined surface of the trailing end aligning wall member 570 (refer to FIGS. 6C and 7A).

When the moved-back trailing end aligning wall member 570 returns to its home position (refer to FIG. 6A) while swinging about the swinging rotary shaft 570*a*, the trailing end aligning wall member 570 urgingly moves the trailing end of the bundle of sheets S in a horizontal direction while aligning the bundle of sheets S at the rear edge thereof, so that the bundle of sheets S is stacked on the stack tray 504 (refer to FIGS. 7B and 7C).

The bundle of sheets S stacked on the stack tray 504 is pulled back toward the trailing end aligning wall member 570 and pressed at the top thereof by a sheet returning member 583. The sheet returning member 583 is a puddle-like member freely rotatable about a puddle rotary shaft 590 provided on the rear end aligning wall member 570. The sheet returning member (puddle) 583 makes one rotation counterclockwise each time a bundle of sheets S is discharged onto the stack tray 504 by the swinging roller 550, and pulls back the discharged bundle of sheets S toward the trailing end aligning wall member 570 to press the trailing end of the bundle of sheets S.

Here, the sheet returning member 583 is kept in a state shown in FIGS. 6A and 6B to press the bundle of sheets S except when it carries out the sheet bundle pulling-back operation. The position of the sheet returning member 583 is detected by a puddle home position sensor, not shown. The stack tray 504 is configured to be moved up and down by a driving mechanism, not shown, so as to keep the height of stacked bundle of sheets S constant.

It should be noted that although in the present embodiment, the stack tray 504 has its sheet stacking surface lying on a substantially horizontal plane, the sheet stacking surface may be inclined. Even if the sheet stacking surface of the stack tray 504 is inclined, the trailing end aligning wall member 570 is capable of operating effectively. Further, if the sheet stacking surface of the stack tray 540 is inclined downward toward the trailing end aligning wall member 570 (in the present embodiment, the angle of inclination is set to 18°), the interference of the trailing end of a bundle of sheets S stacked on the stack tray 540 with the following bundle of sheets S discharged from the processing tray 540 can be easily avoided, and the sheet processing apparatus can be reduced in size.

Figure 8:
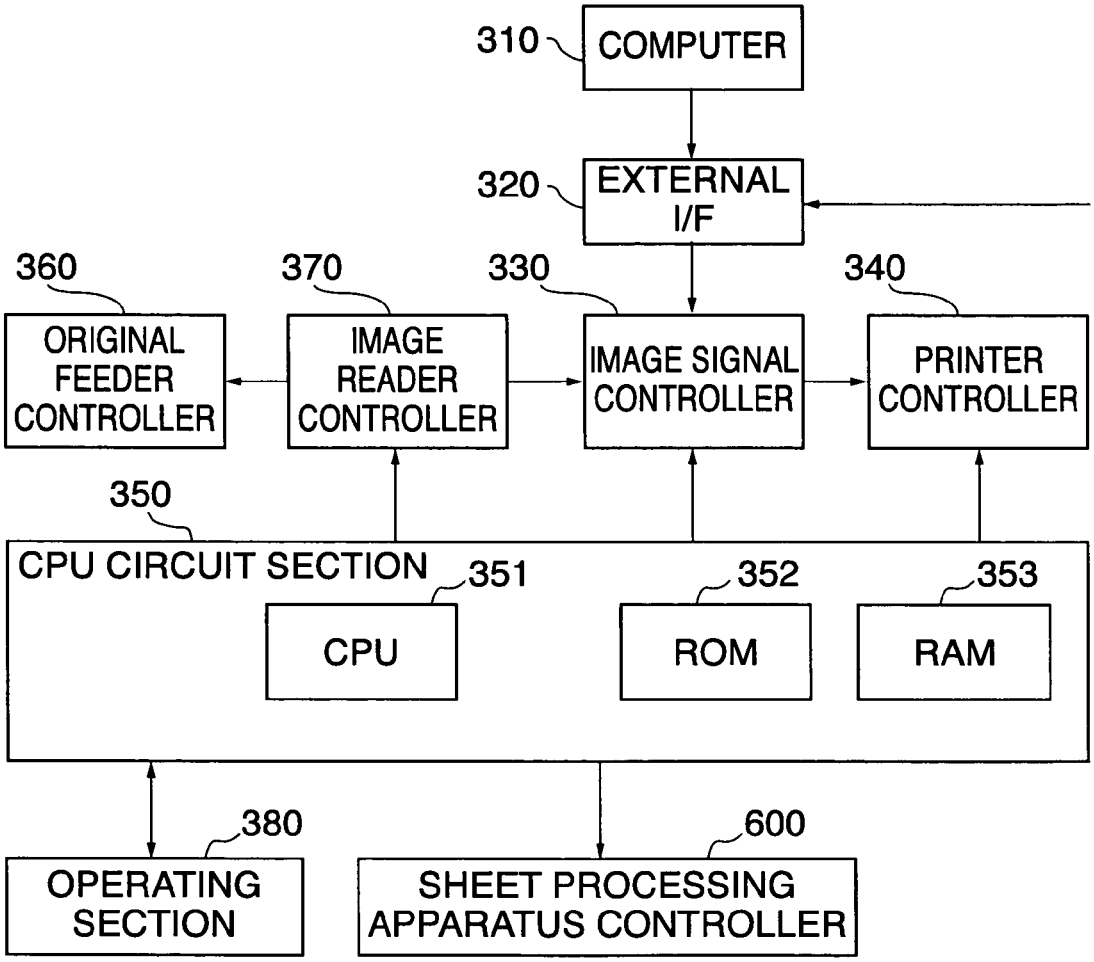
FIG. 8 is a block diagram showing the construction of a controller which controls the overall operation of the image forming apparatus.

FIG. 8 is a block diagram showing the construction of a controller which controls the overall operation of the image forming apparatus. The controller is comprised of a CPU circuit section 350, the operating section 380, a sheet processing apparatus controller 600, an original feeder controller 360, an image reader controller 370, an image signal controller 330, and a printer controller 340. An external computer 310 is connected to the image signal controller 330 via an external interface (I/F) 320.

The CPU circuit section 350 has a CPU 351, a ROM 352, and a RAM 353 incorporated therein. The CPU 351 executes control programs stored in the ROM 352 to collectively control component parts of the controller. The RAM 353 temporarily stores control data, and serves as a working area for arithmetic operations when the CPU 351 executes the control programs.

The original feeder controller 360 controls the automatic original feeder 100 in accordance with instructions from the CPU circuit section 350. The image reader controller 370 controls the scanner unit 104, the image sensor 109, and so forth, and transfers an analog image signal output from the image sensor 109 to the image signal controller 330.

The image signal controller 330 converts the analog image signal output from the image sensor 109 into a digital signal, performs various kinds of processing on the digital signal, converts the resulting digital signal into a video signal, and outputs the video signal to the printer controller 340. Also, the image signal controller 330 performs various kinds of processing on a digital image signal input from the computer 310 via the external I/F 320, converts the resulting digital image signal into a video signal, and outputs the video signal to the printer controller 340. The operation of the image signal controller 330 is controlled by the CPU circuit section 350.

The printer controller 340 drives the laser scanner unit (exposure controller) 202 according to the input video signal. The operating section 380 includes a plurality of keys for setting various functions relating to image formation, a display for displaying setting information, and so forth, and outputs a key signal corresponding to operation of each key to the CPU circuit section 350 and displays the corresponding information on the display according to the key signal from the CPU circuit section 350.

The sheet processing apparatus controller 600 is provided in the sheet processing apparatus 500, for exchanging information with the CPU circuit section 350 to control the overall operation of the sheet processing apparatus 500 as described later.

Figure 9:
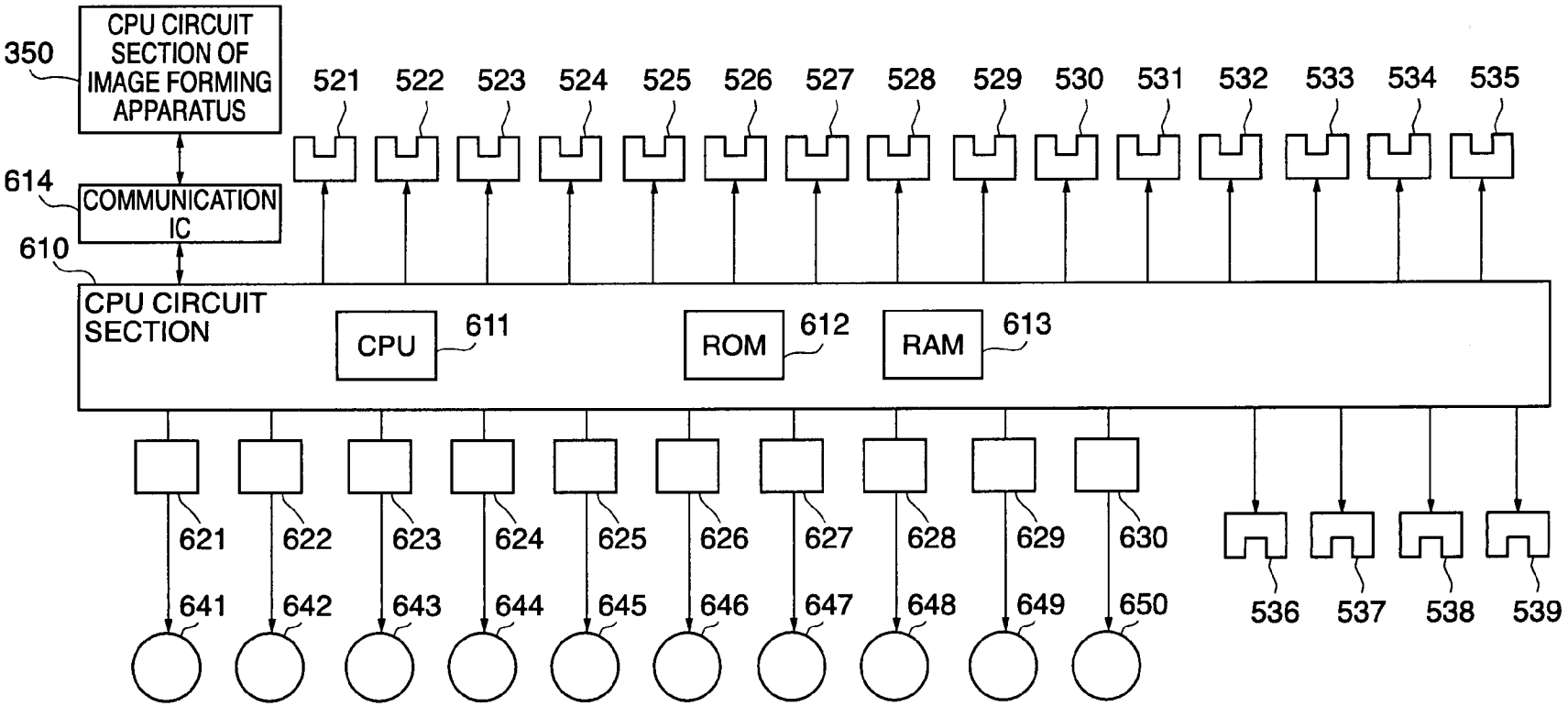
FIG. 9 is a block diagram showing a sheet processing apparatus controller of the controller in FIG. 8.

FIG. 9 is a block diagram showing the construction of the sheet processing apparatus controller 600.

The sheet processing apparatus controller 600 includes a CPU circuit section 610 to which various drivers and various sensors are connected. The CPU circuit section 610 is comprised of a CPU 611, a ROM 612, and a RAM 613. The CPU 611 executes control programs stored in the ROM 612 to control the sheet processing apparatus 500. Further, the CPU circuit section 610 communicates with the CPU circuit section 350 in the main body of the image forming apparatus via a communication IC 614 to exchange data with the same, and controls the sheet processing apparatus 500 in accordance with instructions from the CPU circuit section 350.

To control the sheet processing apparatus 500, the CPU circuit section 610 captures detection signals from various sensors. Examples of the sensors include an inlet sensor 521, a swinging home position sensor 522, a swinging pendulum home position sensor 523, a tray detecting sensor 524, a sheet surface detecting sensor 525, a return belt moving-back sensor 526, a staple slide home position sensor 527, a staple clinch home positions sensor 528, a processing tray sheet detecting sensor 529, a front aligning home position sensor 530, a rear aligning home position sensor 531, a puddle home position sensor 532, a stack tray sheet detecting sensor 533, a stack tray encoder clock sensor 534, a sheet surface detecting upper sensor 535, a sheet surface detecting lower sensor 536, a tray upper limit sensor 537, a tray lower limit sensor 538, a front cover opening/closing detecting sensor 539, and a sheet detecting sensor 595.

Further, various motor drivers 621 to 630 are connected to the CPU circuit 610; the motor drivers 621 to 630 drive corresponding respective motors according to signals from the CPU circuit section 610. Examples of the motors include a sheet discharging motor 641, the swinging roller driving motor 642, the swinging arm driving motor 643, a trailing end aligning wall driving motor 644, a puddle motor 645, the front aligning motor 646, the rear aligning motor 647, the staple clinch motor 648, the staple slide motor 649, and a stack tray motor 650.

A conveying device, which comprises a pair of inlet conveying rollers (discharging section 508) and the discharging roller 508*a* constituting the return belt 560, conveys sheets. The swinging roller driving motor 642 is attached to an end of the swinging arm 551, for driving the swing roller 550 which pulls back a sheet conveyed by the pair of inlet conveying rollers, and discharges a bundle of sheets processed on the processing tray 540 onto the stack tray 504. The swinging arm driving motor 643 drives the swinging arm 551 to swing vertically so as to catch the trailing end of sheets discharged onto the processing tray 540.

The rear end aligning wall driving motor 644 drives the rear end aligning wall member 570 which aligns a bundle of sheets, which has been discharged onto the stack tray 504, at the rear edge thereof. The puddle motor 645 drives the sheet returning member 583 which presses the trailing end of a bundle of sheets stacked on the stack tray 504. The front aligning motor 646 and the rear aligning motor 647 drive the front aligning plate 541 and the rear aligning plate 542 which align sheets stacked on the processing tray 540 in the direction perpendicular to the sheet conveying direction.

The staple clinch motor 648 drives the stapler unit 510 to staple sheets. The staple slide motor 649 moves the stapler unit 510 forward and backward. The stack tray motor 650 moves the stack tray 504 in a vertical direction.

Here, the sheet discharging motor 641, swinging roller driving motor 642, swinging arm driving motor 643, trailing end aligning wall driving motor 644, puddle motor 645, front aligning motor 646, rear aligning motor 647, and staple slide motor 649 are implemented by stepping motors that are each capable of rotating pairs of rollers driven by the respective motors at a constant speed or different speeds by controlling the excitation pulse rate.

Further, the sheet discharging motor 641, swinging roller driving motor 642, swinging arm driving motor 643, front aligning motor 646, rear aligning motor 647, and staple slide motor 649 are capable of being driven to rotate in forward and backward rotational directions by the sheet discharging motor driver 621, swinging roller driving motor driver 622, swinging arm driving motor driver 623, front aligning motor driver 626, rear aligning motor driver 627, and staple slide motor driver 629, respectively. The staple clinch motor 648 and the stack tray motors 650 are each implemented by a DC motor.

Figure 10:
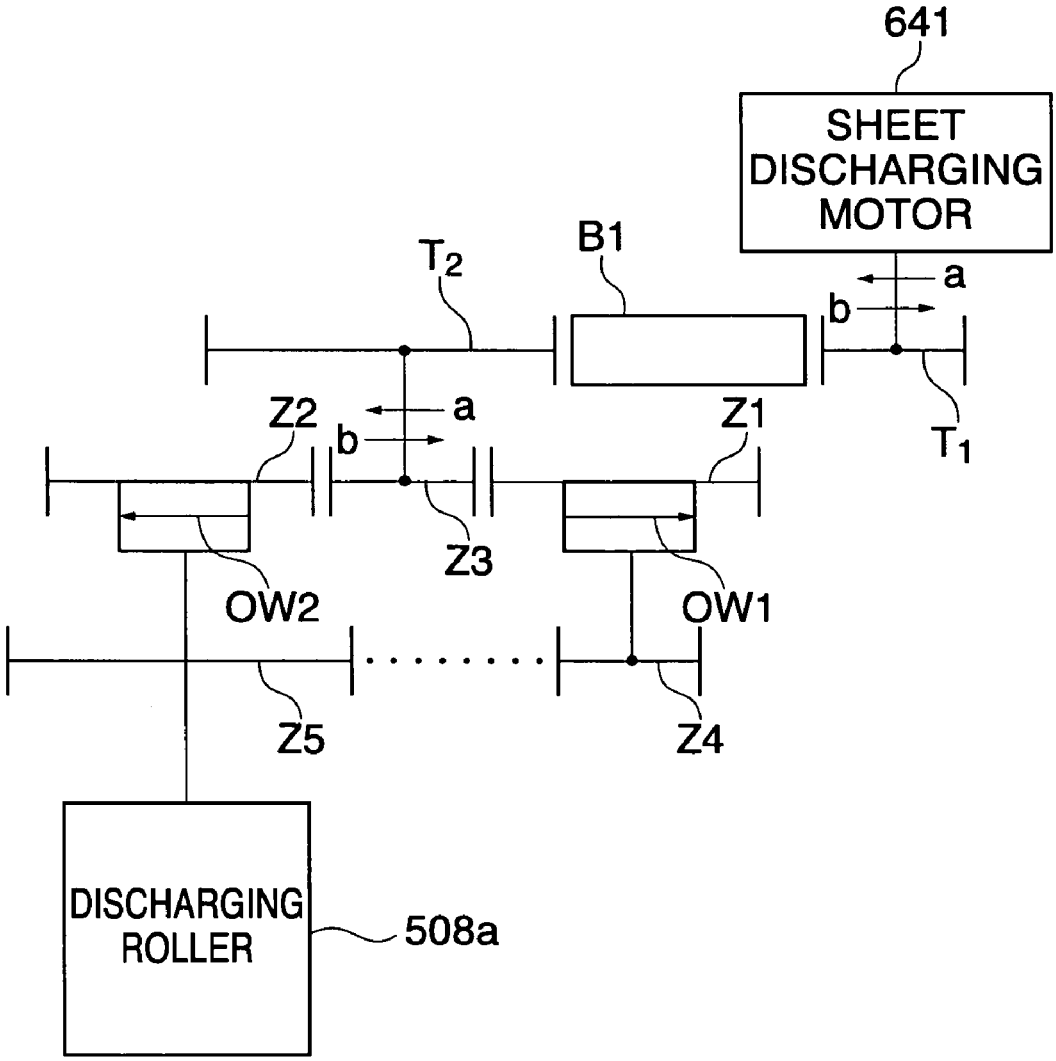
FIG. 10 is a diagram showing the construction of a driving mechanism for discharging rollers in the sheet processing apparatus.

FIG. 10 is a view showing the construction of a driving device for driving the conveying device, namely a mechanism for driving the discharging roller 508*a*. Torque is transmitted from the sheet discharging motor 641 to a gear Z3 via a pulley T1, a belt B1 and a pulley T2. The gear Z3 is engaged with a gear Z1 and a gear Z2. The gear Z1 and the gear Z2 transmit torque in directions indicated by arrows OW1 and OW2, respectively. If the gears Z1 and the gear Z2 are reversed, they are caused to idle and cannot transmit torque.

When the sheet discharging motor 641 is rotated in a direction indicated by an arrow "a" (rotated forward), the gear Z3 is also rotated in the direction indicated by the arrow "a." On this occasion, the rotational direction of the gear Z1 is such a direction that torque is transmitted, but the rotational direction of the gear Z2 is such a direction such that the gear Z1 idles. Therefore, torque of only the gear Z1 is transmitted to gears Z4 and Z5 to rotate the discharging roller 508*a*. In this case, the gear ratio is set to a ratio suitable for conveyance of a sheet at speeds within a first conveying speed range, described later. Thus, a first transmission device for transmitting rotation from the motor 641 to the roller 508*a* of the conveying device at the first conveying speed range includes the pulley T1, the belt B1, the pulley T2, and the gears Z3, Z1, Z4, and Z5.

On the other hand, when the sheet discharging motor 641 is rotated in a direction indicated by an arrow "b" (reverse rotation), the gear Z3 is also rotated in the direction indicted by the arrow "b" and torque of only the gear Z2 rotates the discharging roller 508*a*. In this case, the gear ratio is set to a ratio suitable for conveyance of a sheet at speeds within a second conveying speed range, described later. Thus, a second transmission device for transmitting rotation from the motor 641 to the roller 508*a* of the conveying device at the second conveying speed range includes the pulley T1, the belt B1, the pulley T2, and the gears Z3, Z2, Z4, and Z5. Conversely, the second speed range may be realized by the rotation in the direction indicated by the arrow "a," and the first speed range may be realized by the rotation in the direction indicated by the arrow "b." Further, three or more speed modes (speed ranges) may be provided.

A description will now be given of a sheet conveying speed at which the sheet S transferred from the image forming apparatus main body 200 is conveyed until it is discharged onto the sheet processing tray 540 by the discharging section 508 (pair of inlet conveying rollers) which is comprised of the discharging roller 508*a* on the sheet processing apparatus 500 side and the discharging roller 508*b* following the discharging roller 508*a*.

An image cannot be perfectly fixed unless the fixing rollers 206 in the image forming apparatus main body 200 are not rotated at a speed required for fixing while the sheet S is sandwiched between the fixing rollers 206. Therefore, in the sandwiched state, the sheet cannot be pulled out by the discharging section 508 comprised of the discharging roller 508*a* on the sheet processing apparatus 500 side and the discharging roller 508*b* following the discharging roller 508*a*. The rotational speed of the fixing rollers 206 varies depending upon image forming capability of the image forming apparatus main body 200, sheet conditions such as sheet type such as thickness and weight and color/black-and-white. Further, as described previously, the discharging speed at which the sheet S is discharged from the discharging section 508 to the processing tray 540 needs to be set within the optimum speed range suitable for the construction of the sheet processing apparatus.

In view of the above, irrespective of whether the sheet S is transferred from the image forming apparatus 200 to the sheet processing apparatus at a high speed or a low speed, the discharging speed at which the sheet S is discharged onto the processing tray 540 needs to lie within a predetermined speed range.

Figure 11:
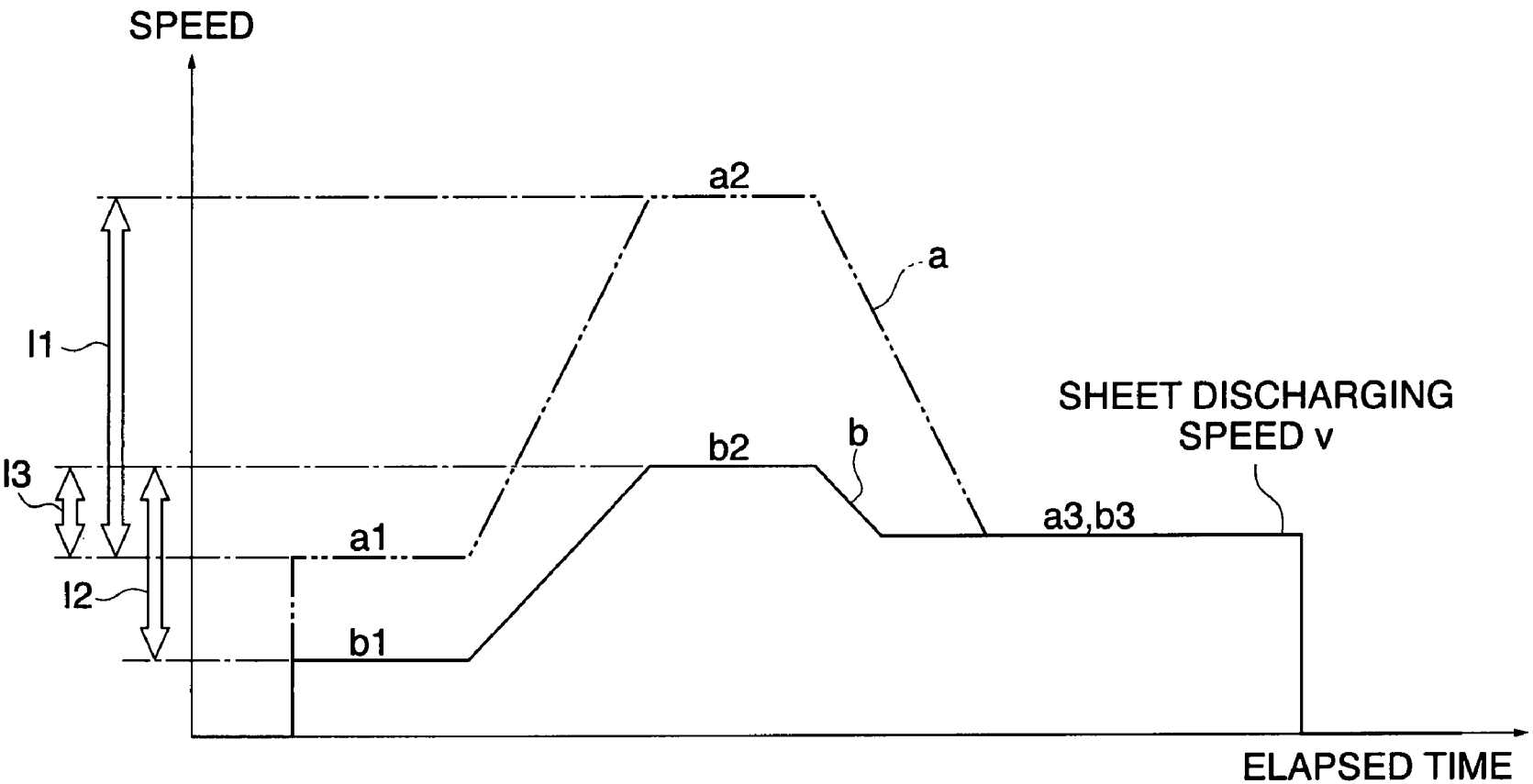
FIG. 11 is a graph showing changes with time in the conveying speed of a sheet conveyed by the discharging rollers.

FIG. 11 is a graph showing changes with time in the sheet conveying speed at which a sheet is conveyed by the discharging roller 508*a*. Specifically, FIG. 11 shows changes (characteristics) in the conveying speed with time in the case where one sheet is conveyed at speeds within the first or second speed range. In FIG. 11, characteristics a and b correspond to the first speed range I1 the second speed range I2, respectively; for example, the characteristics a represent changes in the conveying speed with time in the case where the sheet is thin and light, while the characteristics b represent changes in the conveying speed with time in the case where the sheet is thick and heavy.

In regions a1 and b1 of the respective characteristics a and b, the sheet conveying speed corresponds to a speed at which the sheet is transferred from the image forming apparatus main body 200, and is set to a low speed suitable for fixing. In regions a2 and b2 of the respective characteristics a and b, the sheet conveying speed corresponds to a speed at which the sheet is conveyed after leaving the fixing rollers 206, and is set to a relatively high speed. In regions a3 and b3 of the respective characteristics a and b, the sheet conveying speed is controlled to a discharging speed v suitable for discharge of the sheet from the discharging section 508 to the processing tray 540, and is set within a third speed range, described later.

Further, the first and second speed ranges I1 and I2 are set to such speed ranges as not to necessitate switching between the first speed range I1 and the second speed range I2. Further, the third speed range I3 is set to a speed range where the first speed range I1 and the second speed range I2 overlap. The discharging speed v at which the sheet is discharged form the discharging section 508 toward the processing tray 540 is set within the third speed range I3 as mentioned above, and the discharging speed v is set to the same value or substantially the same value in both cases where the first and second speed ranges, i.e. the characteristics a and b are adopted.

Further, as described above, if the highest speed within the optimum sheet discharging speed range suitable for the construction of the sheet processing apparatus 500 is set as the discharging speed v within the third speed range I3, the period of time required for sheet conveyance can be reduced to the minimum. Further, the optimum discharging speed can be realized irrespective of whether the first speed range comprised of high speeds or the second speed range comprised of low speeds is selected.

Further, the speed range is switched between the first speed range I1 and the second speed range I2 according to sheet conditions such as sheet type such as thickness and weight, material, sheet size, and color/black-and-white. Therefore, various types of sheets can be conveyed in the optimum way, for example, in the case where a slick sheet is conveyed at a low speed. It should be noted that sheet conditions such as sheet type are set by an operator through the operating section 380.

As described above, the sheet S which has been brought into the sheet processing apparatus 500 while being pressed by the discharging rollers 207 of the image forming apparatus main body 200 is guided along the conveying path, and when the sheet S reaches the nip formed by the discharging section 508 comprised of the discharging roller 508*a* and the discharging roller 508*b* following the discharging roller 508*b*, the sheet S is pushed out by the discharging roller 508*a* and discharged toward the stack tray 504. A description will now be given of how to set the first speed range and the second speed range as the range of speeds at which the sheet S is conveyed by the discharging roller 508 on this occasion.

Figure 12:
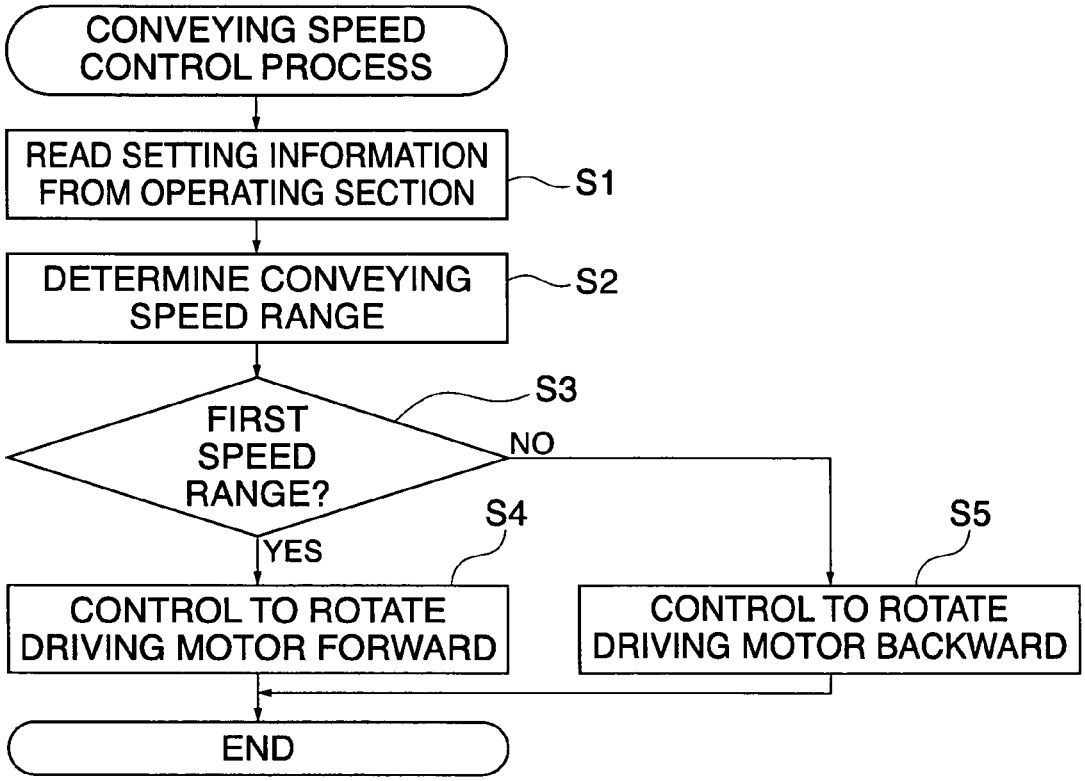
FIG. 12 is a flow chart showing a process for controlling the conveying speed of a sheet conveyed by the discharging rollers.

FIG. 12 is a flow chart showing a process for controlling the speed at which the sheet S is conveyed by the discharging roller 508*a*. A program for implementing the process is stored in the ROM 612 of the sheet processing apparatus controller 600, and is executed by the CPU 611. First, sheet setting information input by an operator through the operating section 380 is read via the CPU circuit section 350 (step S1). The range of speeds at which the sheet S is to be conveyed by the discharging roller 508*a* is set to the first speed range or the second speed range according to the read sheet setting information (sheet conditions), e.g. information on sheet type such as thickness and weight and color/black-and-white (step S2).

It is then determined whether the set speed range is the first speed range or not (step S3). If the set speed range is the first speed range, the sheet discharging motor 641 is controlled to be rotated forward (step S4). On the other hand, if it is determined in the step S3 that the set speed range is the second speed range, the sheet discharging motor 641 is controlled to be rotated backward (step S4). The process is then terminated.

If the sheet discharging motor 641 is controlled to be rotated forward in the step S3, the sheet discharging motor 641 is caused to drive the discharging roller 508*a* so that the sheet conveying speed can be controlled to speeds represented by the characteristics a in FIG. 11, i.e. the sheet conveying speed can be controlled within the first speed range I1. Similarly, if the sheet discharging motor 641 is controlled to be rotated backward in the step S4, the sheet discharging motor 641 is caused to drive the discharging roller 508*a* so that the sheet conveying speed can be controlled to speeds represented by the characteristics b in FIG. 11, i.e. the sheet conveying speed can be controlled within the second speed range I2. Then, the discharging speed v at which the trailing end of the sheet S is discharged from the nip formed by the discharging rollers 508*a* and 508*b* is set to a constant speed within the third speed range where the first and second speed ranges overlap. It goes without saying that the discharging speed v should not necessarily be set to a constant speed, but may be set to arbitrary different speeds within the third speed range.

It should be noted that in the present embodiment, the sheet setting information is input by an operator through the operating section 380, but may be automatically set using a sensor provided in the image forming apparatus to detect e.g. sheet type.

Figure 13:
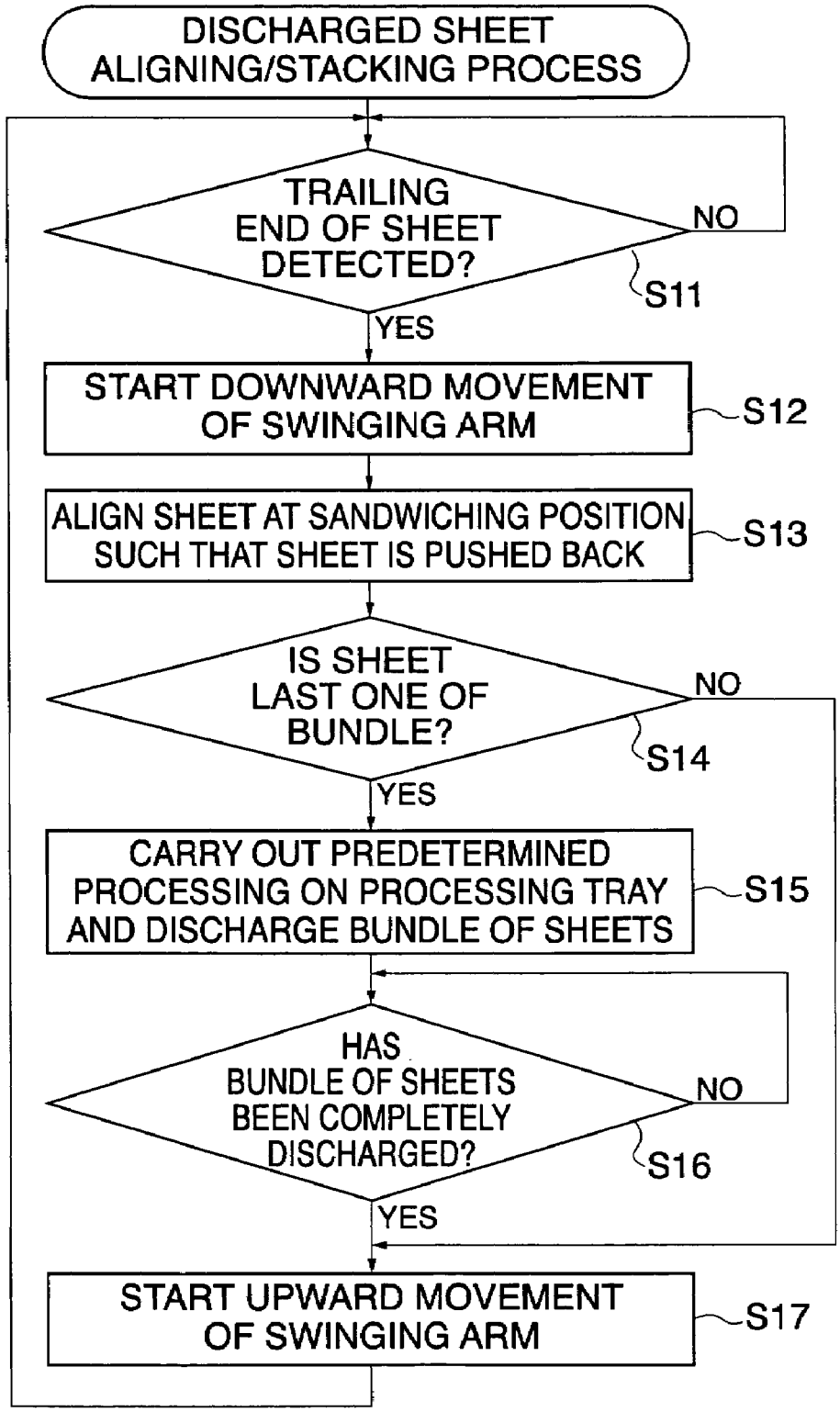
FIG. 13 is a flow chart showing a process for aligning/stacking discharged sheets.

FIG. 13 is a flow chart showing a process for aligning/stacking discharged sheets. A program for implementing the process is stored in the ROM 612 of the sheet processing apparatus controller 600, and is executed by the CPU 611.

It is awaited that the trailing end of a sheet discharged by the discharging roller 508*a* at the discharging speed v is detected by the sheet detecting sensor 595 provided upstream of the discharging roller 508*a* (step S11). When the trailing end of the sheet is detected by the sheet detecting sensor 595, an operation in which the swinging arm 551 is moved down from a waiting position to a sandwiching position is started (step S12).

When the trailing end of the sheet discharged by the discharging roller 508*a* is sandwiched at the sandwiching position between the swinging roller 550 attached to the end of the swinging arm 551 and the following roller 571, the sheet is aligned on the processing tray 540 such that the trailing end of the sheet is pushed back to the sheet trailing end stopper 562 by counterclockwise torque from the swinging roller 550 (step S13).

It is then determined whether the aligned sheet is the last sheet of a bundle or not (step S14). If the aligned sheet is the last sheet of a bundle, predetermined processing is performed on the processing tray 540, and then the bundle of sheets is discharged by clockwise torque from the swinging roller 550 (step S15). It is determined whether the bundle of sheets has been completely discharged or not (step S16), and if the bundle of sheets has been completely discharged, an operation of moving up the swinging arm 551 from the sandwiching position to the waiting position is started (step S17). The process then returns to the step S11. The upward movement of the swinging arm 551 in the step S17 is intended to prevent the leading end of the succeeding sheet from interfering with the swinging arm 551.

On the other hand, if it is determined in the step S14 that the aligned sheet is not the last sheet of a bundle, the operation of moving up the swinging arm 551 is started in the step S17.

After it is detected in the step S16 that the bundle of sheets has been completely discharged, the operation of moving up the swinging arm 551 is started in the step S17.

As described above, in the sheet processing apparatus according to the present embodiment, the discharging speed v is set within the third speed range where the first and second speed ranges overlap. As a result, sheets S can be discharged from the discharging section 508 toward the processing tray 540 at the optimum discharging speed v irrespective of whether the first speed range or the second speed range is selected and irrespective of the conveying speed at which the sheets S are transferred from the discharging rollers 207 of the image forming apparatus main body 200. Further, the forward/backward rotation of the single sheet discharging motor 641 can switch the speed range between the first and second speed ranges, and therefore, the sheet processing apparatus can be simplified in mechanism.

It should be understood that the present invention is not limited to the embodiment described above, but various changes in or to the above described embodiment may be possible without departing from the spirits of the present invention, including changes as described below.

For example, in the above described embodiment, the sheet processing apparatus is provided with the processing tray 540 as an intermediate stacking means, but should not necessarily be provided with it. In the case where the sheet processing apparatus 500 is not provided with the processing tray 540, a sheet stacking/aligning device (comprised of the swinging arm 551, swinging roller 550, trailing end aligning wall member 570, and so forth) which stacks/aligns sheets S with images formed thereon discharged form the image forming apparatus main body 200 is directly mounted on the image forming apparatus main body 200 without the processing tray 540 being interposed therebetween.

Further, in the above described embodiment, the sheet processing apparatus 500 is provided in the housing of the image forming apparatus, but may be provided as an external apparatus outside the housing of the image forming apparatus.

According to the above described embodiment, since the discharging speed is set within a common speed range where e.g. at least two different speed ranges overlap, sheets can always be discharged at the optimum speed irrespective of the selected speed range and even when the sheets are transferred from the image forming apparatus at various conveying speeds.

Further, the present invention may be applied to the case where a position at which the thickness of a sheet, for example, is detected and hence the sheet must be conveyed at a certain constant speed irrespective of the set speed range is present inside the sheet processing apparatus.

Namely, according to the present embodiment, in the case where there are conditions under which sheets must be conveyed at a certain constant speed irrespective of the set speed range, it is possible to accommodate two or more different speed ranges without increasing the size of a drive for conveyance.

What is claimed is:

1. A sheet processing apparatus comprising:

a conveying device that conveys sheets;

a driving device that drives said conveying device and has a motor and a first transmission device for transmitting rotation from said motor to said conveying device and a second transmission device for transmitting rotation from said motor to said conveying device;

a controller for controlling said driving device so that said conveying device conveys a sheet at speeds within a first speed range specified between a first maximum speed and a first minimum speed in a first state in which said first transmission device transmits rotation to said conveying device, and said conveying device conveys a sheet at speeds within a second speed range specified between a second maximum speed lower than the first maximum speed and a second minimum speed lower than the first minimum speed in a second state in which said second transmission device transmits rotation to said conveying device, and wherein the first speed range includes an overlapping range where the first speed range and the second speed range overlap.

2. A sheet processing apparatus according to claim 1, wherein said controller inhibits said driving device from switching between the first state and the second state while said conveying device is conveying one of the sheets.

3. A sheet processing apparatus according to claim 1, wherein a first discharging speed at which the sheets are discharged by said conveying device in the first state is substantially equal to a second discharging speed at which the sheets are discharged by said conveying device in the second state, and the first discharging speed lies inside the overlapping range.

4. A sheet processing apparatus according to claim 1, wherein said conveying device receives sheets traveling at at least two different receiving speeds, and at least one of the receiving speeds lies outside the first speed range and lies inside the second speed range.

5. A sheet processing device according to claim 1, wherein:

wherein said first transmission device transmits rotation from said motor to said conveying device when said driving motor rotates in one direction; and wherein said second transmission device transmits rotation from said motor to said conveying device when said driving motor rotates in a direction opposite to the one direction.

6. A sheet processing apparatus according to claim 1, wherein one of said first and second transmission devices drives said conveying device while said conveying device is conveying a sheet and the one transmission device is not changed to the other of said first and second transmission devices while said conveying device is conveying the sheet.

7. A sheet processing apparatus according to claim 1, wherein one of said first state or said second state is selected according to conditions of the sheets to be conveyed.

8. A sheet processing apparatus according to claim 1, wherein said conveying device is for conveying sheets discharged from an image forming apparatus.

9. A sheet processing apparatus according to claim 1, wherein a conveying speed at which the sheets are conveyed at a predetermined position is set to a speed within the overlapping range where said first speed range and second speed range overlap.

10. A sheet processing apparatus according to claim 9, further comprising a conveying path and a stacking device that stacks sheets having been guided to said conveying path and discharged therefrom, wherein the conveying speed at said predetermined position is a discharging speed at which the sheets are discharged from said conveying path to said stacking device.

11. A sheet processing apparatus according to claim 10, further comprising a sandwiching device that lowers and sandwiches trailing ends of the sheets discharged from said conveying path, wherein said sandwiching device stacks the sheets in said stacking device by pulling back the lowered trailing ends of the sheets.

* * * * *